US012459771B2

(12) United States Patent
Rodriguez et al.

(10) Patent No.: US 12,459,771 B2
(45) Date of Patent: Nov. 4, 2025

(54) METHOD AND APPARATUS FOR SEPARATING AND SPOOLING A PAPER WEB

(71) Applicant: Sandar Industries, Inc., Atlantic Beach, FL (US)

(72) Inventors: Peter Rodriguez, Jacksonville, FL (US); Jason Rodriguez, Jacksonville, FL (US); Craig Austin, Jacksonville, FL (US)

(73) Assignee: Papeltec Overseas, Inc., Atlantic Beach, FL (US)

( * ) Notice: Subject to any disclaimer, the term of this patent is extended or adjusted under 35 U.S.C. 154(b) by 604 days.

(21) Appl. No.: 17/713,231

(22) Filed: Apr. 5, 2022

(65) Prior Publication Data

US 2022/0315368 A1 Oct. 6, 2022

Related U.S. Application Data

(60) Provisional application No. 63/170,597, filed on Apr. 5, 2021, provisional application No. 63/170,598, filed on Apr. 5, 2021.

(51) Int. Cl.
*B65H 19/26* (2006.01)
*B65H 19/28* (2006.01)

(52) U.S. Cl.
CPC ..... *B65H 19/262* (2013.01); *B65H 19/267* (2013.01); *B65H 19/283* (2013.01);
(Continued)

(58) Field of Classification Search
CPC .... B65H 19/28; B65H 19/283; B65H 19/286; B65H 19/262; B65H 19/967; B65H 2301/41427; B65H 2301/41428; B65H 2301/4176; B65H 2301/41764; B65H 2301/41766; B65H 2301/376;
(Continued)

(56) References Cited

U.S. PATENT DOCUMENTS 2,461,246 A 2/1949 Weyenberg
4,320,835 A * 3/1982 Polhemus ..... B65H 35/0026 206/214

(Continued)

FOREIGN PATENT DOCUMENTS

EP 0728823 A2 * 8/1996 ..... C09J 7/02

OTHER PUBLICATIONS

International Preliminary Report on Patentability, issued Oct. 10, 2023 in correlated International Application No. PCT/US2022/023376.

(Continued)

*Primary Examiner* — Anna M Momper
*Assistant Examiner* — Raveen J Dias
(74) *Attorney, Agent, or Firm* — Joseph P. Kincart; Tracnik Law PLLC

(57) ABSTRACT

A family of paper tape turn-up constructs for accomplishing automated paper web turnup in paper processing. Methods and apparatus to form the constructs are described. Methods and Apparatus to apply the constructs to paper production equipment are also described. In some examples, the paper tape turn-up construct includes a cover flap to protect an adhesive layer during initiation of the paper web turn up process.

16 Claims, 17 Drawing Sheets

(52) U.S. Cl.
CPC ..... *B65H 2301/41427* (2013.01); *B65H 2301/41428* (2013.01); *B65H 2301/41764* (2013.01); *B65H 2408/236* (2013.01)

(58) Field of Classification Search
CPC ..... B65H 2301/377; B65H 2701/1722; B65H 2701/17222; B65H 75/28; B65H 2408/236; B65H 37/06; B65H 35/0006; B65H 35/0013; B65H 35/002; B65H 35/0026; B65H 35/0033; B65H 35/004; B65H 35/0046; B65H 35/0053
See application file for complete search history.

(56) References Cited

U.S. PATENT DOCUMENTS 4,659,029 A 4/1987 Rodriguez
4,711,404 A * 12/1987 Falk ..... B65H 19/262 242/542.3
4,757,950 A 7/1988 Rodriguez
4,783,018 A 11/1988 Rodriguez
5,046,675 A 9/1991 Rodriguez
5,105,944 A * 4/1992 Ingalls ..... B65H 75/28 206/412
5,323,981 A * 6/1994 Dionne ..... C09J 7/30 242/588.3
5,417,383 A 5/1995 Rodriguez et al.
5,453,141 A 9/1995 Rodriguez
5,542,622 A * 8/1996 Biagiotti ..... B65H 35/10 242/521
5,595,626 A * 1/1997 Yokouchi ..... B65H 35/0033 225/56
5,601,243 A * 2/1997 Inagaki ..... B65H 19/28 242/582
5,637,170 A 6/1997 Rodriguez
5,646,090 A 7/1997 Tamura et al.
5,954,290 A 9/1999 Rodriguez et al.
5,992,490 A * 11/1999 Kakita ..... B65H 35/0026 156/522
6,056,229 A * 5/2000 Blume ..... B65H 19/2269 242/541.2
6,443,387 B1 9/2002 Mercer et al.
6,467,719 B1 10/2002 Rodriguez
6,547,178 B2 * 4/2003 Rodriguuez ..... B65H 19/28 242/532.3
6,578,788 B2 6/2003 Rodriguez et al.
6,695,190 B1 * 2/2004 Gunter, Jr. ..... B65H 35/002 225/56
7,078,082 B2 * 7/2006 Adams ..... B65H 19/28 156/185
7,172,151 B2 2/2007 Biagiotti et al.
7,757,990 B2 7/2010 Tiitta et al.
7,766,273 B2 * 8/2010 Rodriguez ..... B65H 19/283 242/525
7,875,152 B2 1/2011 Rodriguez
8,124,209 B2 2/2012 Rodriguez
8,178,181 B2 5/2012 Rodriguez
8,580,062 B2 * 11/2013 Rodriguez ..... B65H 19/262 156/289
9,102,491 B2 * 8/2015 Rodriguez ..... B65H 19/262
10,384,900 B2 8/2019 Rodriguez et al.
10,442,648 B2 10/2019 Rodriguez et al.
11,142,382 B1 * 10/2021 Hayes ..... C09J 7/20
11,834,287 B1 * 12/2023 Rodriguez ..... B65H 19/2261
11,884,499 B1 * 1/2024 Austin ..... B65H 19/267
11,952,227 B1 * 4/2024 Rodriguez ..... C09J 7/21
12,240,718 B2 * 3/2025 Rodriguez ..... B65H 19/267
2002/0027179 A1 * 3/2002 Fujiwara ..... B65H 19/28 242/532.3
2002/0069974 A1 * 6/2002 Niermann ..... B65H 35/0073 156/577
2002/0134879 A1 * 9/2002 Rodriguuez ..... B65H 19/28 242/532.3
2004/0134591 A1 * 7/2004 Beck ..... C09J 7/29 428/40.1
2004/0238109 A1 * 12/2004 Gonzalez ..... B65H 35/0026 156/227
2005/0155714 A1 * 7/2005 Adams ..... B65H 19/10 242/555.3
2005/0194489 A1 * 9/2005 Rodriguez ..... B65H 19/283 242/532.3
2006/0011767 A1 * 1/2006 Biagiotti ..... B65H 19/28 242/526
2006/0141216 A1 * 6/2006 Hartman ..... D03D 15/247 428/156
2007/0095967 A1 5/2007 Biagiotti et al.
2008/0061183 A1 * 3/2008 Rodriguez ..... B65H 19/283 242/521
2008/0113142 A1 5/2008 Rodriguez
2008/0135158 A1 * 6/2008 Baumli ..... B65H 19/28 156/187
2008/0149757 A1 * 6/2008 Tiitta ..... B65H 19/28 428/40.1
2009/0022986 A1 1/2009 Wesselmann et al.
2009/0054219 A1 * 2/2009 Wu ..... B65H 75/28 492/22
2009/0173819 A1 * 7/2009 Maddaleni ..... B65H 19/2269 242/527.3
2010/0104792 A1 * 4/2010 Rodriguez ..... B65H 19/102 428/40.1
2010/0163665 A1 * 7/2010 Gambini ..... B65H 19/267 242/521
2011/0133015 A1 * 6/2011 Gelli ..... B65H 19/2269 242/521
2013/0020427 A1 * 1/2013 Gelli ..... B65H 19/2269 242/521
2014/0054407 A1 * 2/2014 Mazzaccherini .. B65H 19/2276 242/522
2018/0339874 A1 * 11/2018 Rodriguez ..... B65H 35/004
2018/0339875 A1 11/2018 Rodriguez et al.
2019/0010009 A1 * 1/2019 Fujisawa ..... B43L 19/0068
2022/0204296 A1 * 6/2022 Rodriguez ..... B65H 19/283
2022/0315369 A1 * 10/2022 Rodriguez ..... B65H 19/267
2022/0380158 A1 * 12/2022 Austin ..... B65H 19/2261

OTHER PUBLICATIONS

International Preliminary Report on Patentability, issued Oct. 10, 2023 in correlated International Application No. PCT/US2022/023375.

* cited by examiner

METHOD AND APPARATUS FOR SEPARATING AND SPOOLING A PAPER WEB

CROSS REFERENCE TO RELATED APPLICATIONS

This application claims the benefit of U.S. Provisional Patent Application 63/170,598 filed Apr. 5, 2021, the contents of which is incorporated herein by reference in its entirety. And, this application also claims the benefit of U.S. Provisional Patent Application 63/170,597 filed Apr. 5, 2021, the contents of which is incorporated herein by reference in its entirety.

BACKGROUND OF THE INVENTION

Modern paper manufacturing is typically performed by producing continuous lengths of paper having widths of over 400 inches in some cases, referred to as paper webs, which are wound onto web spools for subsequent converting, storage, transfer or the like.

A winding or spooling operation for a paper web, such as in the case of tissue grades, occurs at high speeds which in some cases, exceeds six thousand (6000) feet per minute. In order to maximize production by minimizing downtime and waste, it is desirable to sever and simultaneously transfer a moving paper web from a full spool which may be called a parent roll onto an Empty Web Spool without stopping, adjusting draws (e.g., the speed differential between the incoming and outgoing web rotating support members that are not driven by a common source) or slowing the movement of the web.

Methods and apparatuses for accomplishing this severing and transfer utilizing what is known as a transfer or Turn-Up tape are known. An early example of such a system is shown in U.S. Pat. No. 2,461,246 to Weyenberg, issued in 1949. Other examples are shown in our U.S. Pat. Nos. 4,659,029, 4,757,950, 4,783,018, 5,046,675, 5,453,141, 5,637,170, and 5,954,290. Further examples and detailed discussion of such equipment, systems and methodologies are present in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures of which are incorporated herein by reference.

A high-speed transfer of lightweight paper webs, such as groundwood papers (including, for example, newsprint) or tissue paper, is more difficult to accomplish due to a weaker structure of such papers. In addition, in systems using adhesive Transfer Tapes for the web transfer, an exposed adhesive side of the Transfer Tape is often contaminated with airborne dust, floating paper fibers and other debris, which are prevalent in an environment for manufacturing the lightweight paper webs. The contamination is detrimental to the adhesion properties of the Transfer Tape, which is weakened or even substantially removed, which can result in a failed transfer.

A failed transfer results in one or more of: lost production, inconsistent winding of the product, inconsistent roll sizes, excessive waste, shorter service life of the fiber cores which are commonly used in tissue making machines, and unsafe operating conditions.

SUMMARY OF THE INVENTION

Accordingly, the present invention provides apparatus and methods overcoming problems related to contamination of an exposed adhesive on a Transfer Tape deployed during a Turn-Up operation. The present invention provides apparatus and methods that enable a Transfer Tape to be dispensed in a desired length suitable for performing a Turn-Up operation while protecting an adhesive surface from contamination.

Therefore, the present invention relates generally in a first sense to the field of devices, apparatus and methods of effecting more reliable and consistent high-speed severing and transfer of a rapidly advancing paper web from a rotating Parent Web Spool onto an Empty Web Spool, and more particularly to improvements of such an operations performed with a light density or tissue paper web.

More particularly, the present invention provides improved Transfer Tapes and methods for using the improved Transfer Tapes. The improved Transfer Tapes include a layered structure including adhesive and Transfer Tape substrate layers to define a Transfer Tape construct which has a Cover Flap that protects an adhesive layer during storage and initiation of use and then becomes uncovered during operation. An important aspect of improvement in a Transfer Tape may be the movement of an adhesive layer to be underneath and attached to the Cover Flap, The adhesive surface is still protected when the Cover Flap is closed, but when it opens the adhesive being on the Cover Flap creates new and favorable implementation aspects. As the Cover flap opens and moves the adhesive with it, the adhesive may now reach across an open nip improving the interaction of the adhesive.

The improved Transfer Tape may be installed upon a spool in preparation for the spool to be used. As is described in the sections that follow, the various examples of a Transfer Tape Construct with a Cover Plate have an adhesive layer of the Cover Plate that opens up with the Cover Plate. In the initially stored form, the Cover Plate and attached adhesive layer are all closed together. Under the use of the spool with the attached Cover Plate the forces involved open up the cover plate. The adhesive bond to the Cover Plate may be optimized for significant adhesive strength; however, the adhesive bond to layers underneath the adhesive is designed to be relatively weak. The layer that the cover plate adhesive is applied to may be zone coated for reduced adherence. Thus, as the Cover Plate opens, the attached adhesive releases from underneath and is held by the Cover Plate as it moves off of the area close to the spool surface.

The improved Transfer Tape may also include a Release Layer. The invention further provides for creating such Cover Flap structures where the adhesive layer is connected to and part of the Cover Flap such that it presents an elevated adhesive surface to bind to the paper web. The present invention also relates to the use of this structure in a paper web Turn Up including severing and transfer of a Paper Web from a Parent Web Spool to an Empty Web Spool. A dispensing apparatus may be used to attach rolls of the Cover Flap layered construct upon an Empty Web Spool. In some examples, the Cover Flap construct may be preassembled with varying designs of Transfer Tape substrate layers and pressure sensitive adhesive (PSA) layers or other types of adhesive layers to form the construct. In some examples, release coatings may be used to modify aspects of the Transfer Tape substrate across its surface or portions of its surface to create adhesion interaction which include regions that are permanently bonded as well as regions which have minimal adherence between the adhesive layer and the Transfer Tape substrate.

Reduced adhesion aspect may allow for the described function of the Cover Flap to lift off on one of its edges of the Transfer Tape substrate and present the paper web with a fresh adhesive surface to bind to. The pressure sensitive adhesive may be coated, layered, or laminated to the paper in various examples. The dispensing apparatus may comprise a dispensing system for dispensing rolls of the Cover Flap layered constructs and can press the adhesive layers to the Empty Web Spool.

A type of Transfer Tape which assists Turn-Up and deals with the environmental issues such as dust in the environment may include a Cover Flap that is maintained over the adhesive surface of the Transfer Tape to shield it from the particles, dust and other materials that can bind to and block the adhesive. The Cover Flap may be caused to open during the processing and subsequently allow the adhesive surface to be free to interact with and bind to the paper web of the paper processes. Reliable opening of a Cover Flap and proper interaction of a Transfer Tape with a Parent Web Spool and an Empty Web Spool is on ongoing priority during paper making.

The improved apparatus and methods presented herein for utilizing a Transfer Tape with a Cover Flap to sever and transfer a continuous paper web from one spool to another spool, may be particularly useful in transferring lightweight papers such as, for example, one or both of: tissue paper and newsprint, from a Parent Web Spool to an. Empty Web Spool

DETAILED DESCRIPTION OF THE INVENTION

Figures 1, 1A:
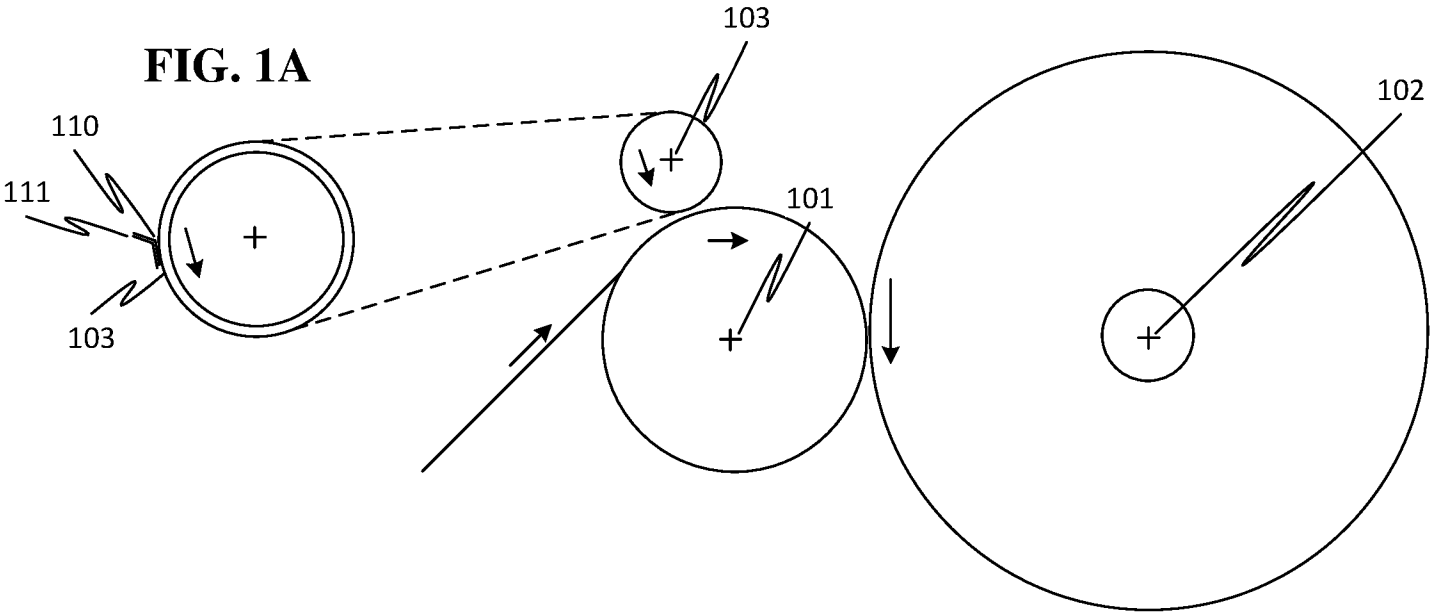
FIG. 1 is an illustration of a paper processing system where an Empty Web Spool has been set up for paper web transfer.
FIG. 1A is an enlarged view of an exemplary Cover Flap transfer paper construct for Turn-Up.

With reference to the drawings, which are provided for descriptive and illustrative purposes which are not meant to be limiting as the scope of the invention, the invention in various embodiments in a broad and general sense is an apparatus and a method for producing and for attaching a Cover Flap Transfer Tape Construct which may be used in a paper web Turn-Up operation. The process may facilitate the Turn-Up operation wherein a continuous paper web being rolled onto a Parent Web Roll is severed and transferred to an Empty Web Spool when the Parent Web Spool nears a fully wound state. In the operation, the transfer may occur without requiring the flow of the paper web to be temporarily altered or stopped. It is to be understood that disclosure of the apparatus and method in relation to a paper web Turn-Up operation is an exemplary disclosure not meant to be limiting, as the Cover Flap Transfer Tape Construct its methods of manufacture and associated apparatus may be suitable for use in different industrial applications.

GLOSSARY

Cover Flap Construct: as referred to herein refers to a physical layer positioned to mitigate exposure of an adhesive layer to environmental contaminant. During performance of a Turn-Up, at least a portion of the Cover Flap Construct will be moved to expose at least ap portion of the adhesive layer that the Cover Flap Construct protected from environmental contaminant.

Turn-Up: as used herein means a process involving switching a paper web from a nearly completed parent web spool to an empty web spool. A Turn-up process may include severing a paper web from a rotating parent web roll nearing its capacity to hold paper, transferring the paper web to an empty web spool, and securing the paper web to the empty web spool.

Transfer Tape: as used herein means a Transfer Tape, sometimes referred to as a turn-up tape, refers to a substrate adapted for extending across a longitudinal cylindrical surface of one or both of an empty web spool and a paper bearing web spool. The transfer tape may include multiple layers.

Web Binding Adhesive: as used herein a Web Binding Adhesive, sometimes referred to as Web Grabbing Adhesive, refers to an adhesive layer of a transfer tape that attaches the transfer tape to a paper web. During paper manufacture and/or processing, a paper web that is attached via web binding adhesive may be pulled to a spool that a transfer tape is adhered to.

Mounting adhesive: as used herein a Mounting Adhesive refers to an adhesive used to bind transfer tape constructs together and/or used to hold a transfer tape construct to a spool.

Pressure Sensitive Adhesive: as used herein a Pressure Sensitive Adhesive refers to a non-reactive adhesive which creates binding force when pressure is applied to attach the adhesive to a surface.

Nip: as used herein Nip refers to the area where a paper web or sheet is pressed between two rolls/spools.

Parent Web Roll: as used herein a Parent Web Roll, which may be called an Old Spool, refers to a web spool that is substantially nearing its capacity for holding paper web.

Empty Web Spool: as used herein an Empty Web Spool, sometimes referred to as an Empty Reel, a New Spool, or an Empty Spool, may include a reel that paper web being reeled onto a Parent Roll is transferred to. The surface of an Empty Web Spool is commonly used to adhere a transfer tape upon.

Reel Drum: as used herein a Reel Drum refers to a spool used to drive movement of a paper web; in some embodiments a reel Drum may impart rotational movement to a Parent Roll receiving a paper web in a reeling action.

With reference to the drawings, which are provided for descriptive and illustrative purposes which are not meant to be limiting as the scope of the invention, the invention in various embodiments in a broad and general sense is an apparatus and a method for processing and applying a Cover Flap Transfer Tape Construct which may be used in a paper web turn-up operation. The process may facilitate the turn up operation wherein a continuous paper web being rolled onto a first web spool is severed and transferred to an empty second web spool when the first web spool is fully wound. In the operation, the transfer may occur without requiring the flow of the paper web to be temporarily altered or stopped. It is to be understood that disclosure of the apparatus and method in relation to a paper web turn-up operation is an exemplary disclosure not meant to be limiting, as the Cover Flap Transfer Tape Construct, methods of its manufacture and associated applicators and methods of application may be suitable for use in different industrial applications.

The present invention provides improved methods and apparatus for utilizing a Cover Flap Transfer Tape Construct to sever and transfer a continuous paper web from one spool to another spool, such as may be especially useful in transferring lightweight papers such as tissue or newsprint Empty Web Spool. The Cover Flap Transfer Tape Construct may be applied to an Empty Web Spool Nip in a closed position such that the Cover Flap is temporarily adhered in a portion of its surface and opens during the run up in the speed of the spool to which it is attached due both to aerodynamic forces and to centrifugal force. In examples of the present application, the construct is produced so that when the cover flap opens, the adhesive layers open with the Cover Flap presenting the adhesive off of the surface of the spool. Thus, the adhesive layer is elevated to interact with the paper web.

The Cover Flap Transfer Tape Construct may be produced by assembling layers of structural materials, such as paper, along with layers of adhesive material, such as double stick adhesive tapes. Coatings of various kinds may be applied to the surfaces of the layers to alter properties of the surface. A release layer may be performed by coating a portion of a surface, such as with a silicone coating, that renders the surface as less adherent to an adhesive that may be attached to it. In a non-limiting example, if a portion of a surface of a structural layer is coated with a release coating, then an attached adhesive layer will form a strong bond with the uncoated portion and a weaker bond with the coated portion such that when forces are applied the adhesive will separate from the coated surface and lift up.

Referring to FIG. 1, a starting step of a paper Turn-Up process utilizing the concepts of the present specification is illustrated. In the first (starting) step an operator has prepared the Cover Flap Transfer Tape Construct on an Empty Web Spool 103. The Empty Web Spool 103 may be used to take up the new paper web 100 as it is moved by the Reel Drum 101 in the direction as shown by the arrows. At the starting step, the Parent Web Roll 102 is approaching its capacity to take up the paper web 100. In the inset figure, FIG. 1A, an enlarged view of the Empty Web Spool 103 is illustrated. on the surface of the Empty Web Spool is the Cover Flap transfer paper 111 which is held to the Empty Web Spool 103 with an adhesive layer 110.

Figures 2, 2A:
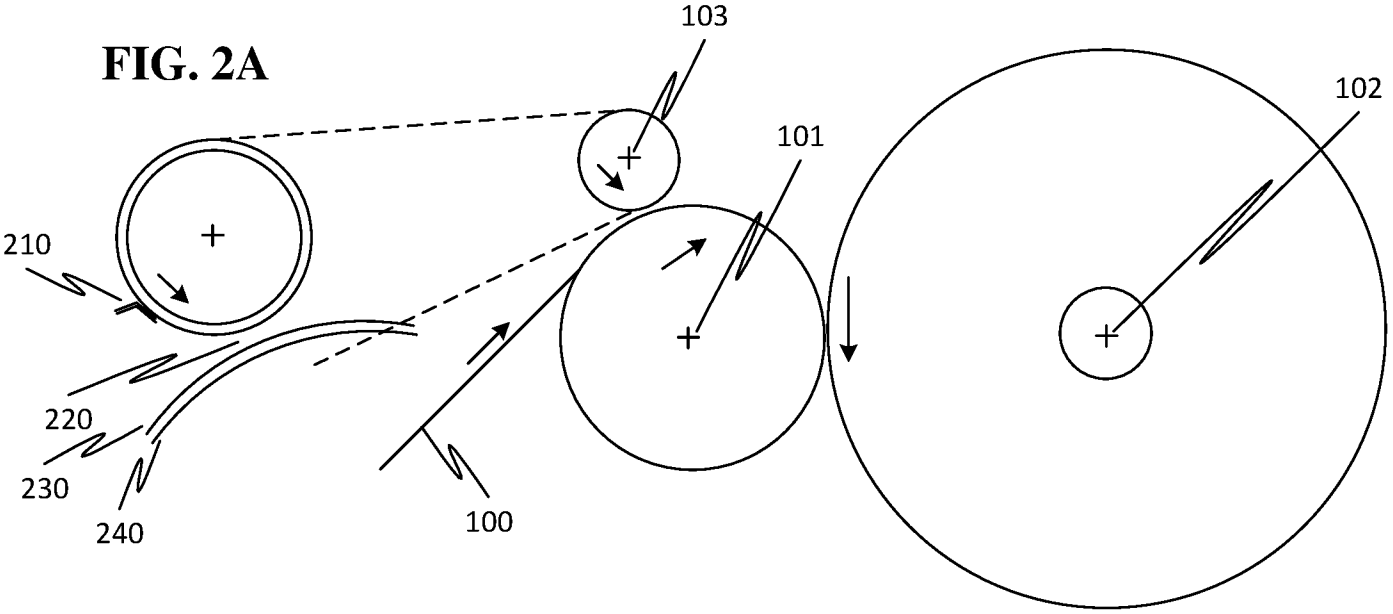
FIG. 2 is an illustration of a paper processing system where the Cover Flap transfer paper construct is approaching the Nip.
FIG. 2A is an enlarged view of an exemplary Cover Flap transfer paper construct as it approaches the Nip.

Referring now to FIG. 2, the Empty Web Spool 103 approaches the Nip as it moves towards the reel drum 101. The paper web 100, is still wrapping to the Empty Web Spool 102. As displayed in FIG. 2A, the Cover Flap Transfer Tape Construct 210 sits on the surface of the Empty Web Spool 103. As the Empty Web Spool approaches the Nip 220 it will contact the paper web 230 which is upon the reel drum surface 240 and be rotated as shown by the arrows. Rotation may be accomplished, for example, via an electric or air powered motor (not illustrated). In some examples, the motor described may bring the Empty Web Spool up to speed prior to it approaching the spool and closing the Nip. The rotary speed (rotations per minute) of the Empty Web Spool may be such that its surface speed equals that of the paper web and reel drum surface. During the run up of that speed, the Cover Flap of the Cover Flap Transfer Tape Construct may open up. The speed of the spool may create an apparent "wind" or aerodynamic force against the surface of the Cover Flap Transfer Tape Construct to open the flap. As well, as the spool rotational speed increases the centrifugal force on the Cover Flap also increases to encourage it to open.

The rotation may bring the opened Cover Flap Transfer Tape Construct 210 into the Nip 220 which will put pressure onto the exposed adhesive surface. In some examples, the cover flap adhesive will approach the paper web when the Empty Web Spool is brought into close contact with the paper web on the reel drum. It is unique, in the embodiments discussed herein, that the adhesive will join the cover flap in lifting off the Transfer Tape Construct. As may be seen in the illustration, the fact that the adhesive is on the back of the Cover Flap brings the adhesive closer to the paper web.

Figures 3, 3A:
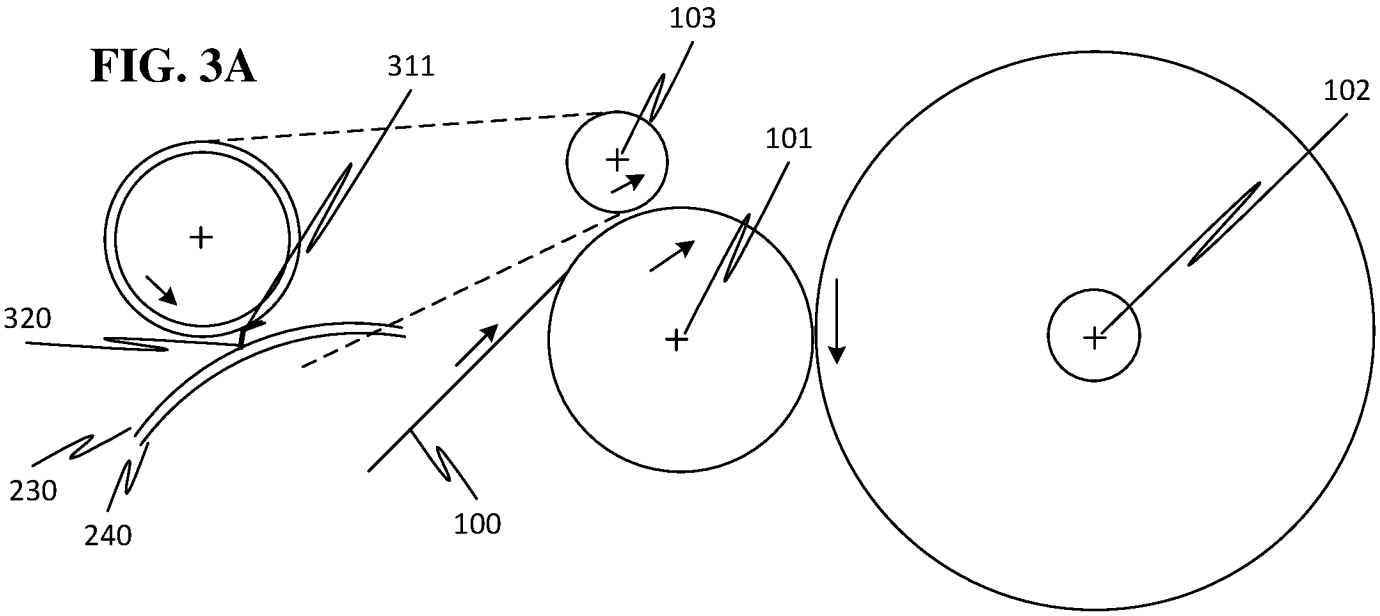
FIG. 3 is an illustration of a paper processing system where the Cover Flap transfer paper construct are compressed between the Empty Web Spool and the reel drum.
FIG. 3A is an enlarged view of an exemplary Cover Flap transfer paper construct as it is compressed.

In an example, proceeding now to FIGS. 3 and 3A, when the Cover Flap Transfer Tape Construct is in the Nip 320, the Cover Flap 311 may be pressed to adhere to the paper web 100 in the Nip 320. It may be noted that the proportions of the components in the figures may be exaggerated for the thickness or relative size to the spool and are illustrated for purposes of clarity.

Figures 4, 4A:
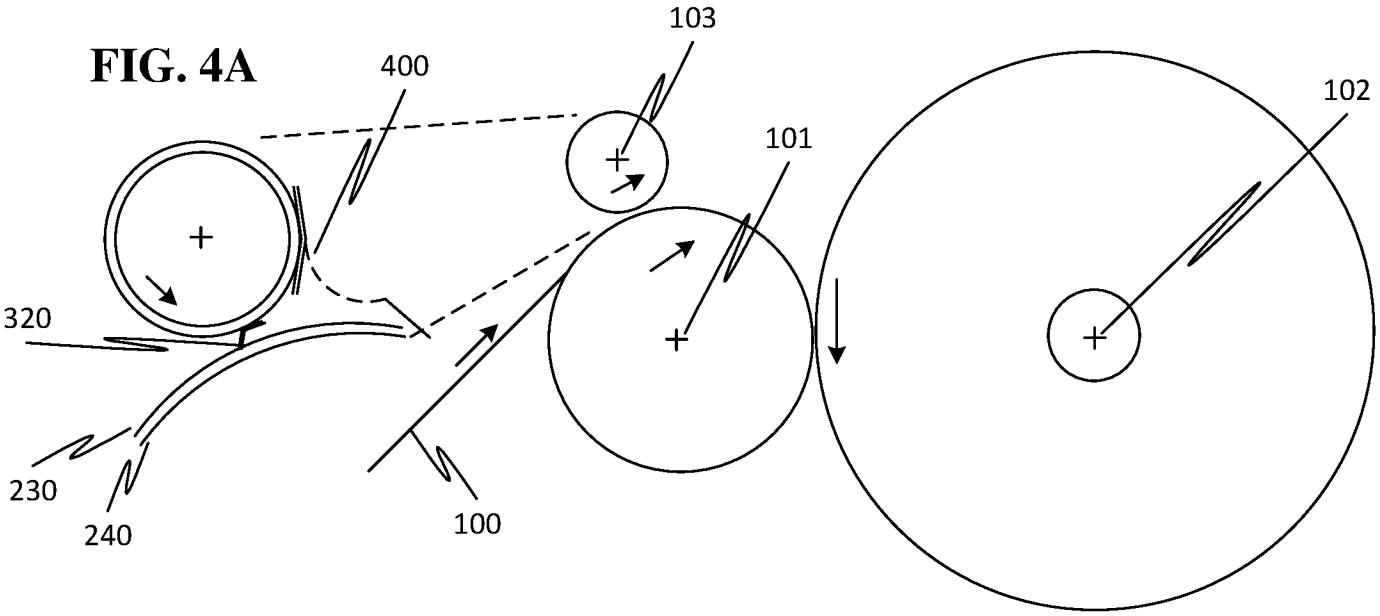
FIG. 4 is an illustration of a paper processing system where the Cover Flap of the Cover Flap transfer paper construct grabs the advancing paper web.
FIG. 4A is an exploded view of an exemplary Cover Flap transfer paper construct as it grabs the advancing paper web.

Proceeding now to both FIGS. 4 and 4A, the adhesion of the paper web 400 as the reel drum 101 rotates and lifts the paper toward the Empty Web Spool 103. The Cover Flap Transfer Tape Construct location is rotating out of the Nip 320 as new paper from the paper web 230 advances on the reel drum surface 240. As discussed, the illustrations are exemplary and are provided to illustrate fundamental aspects of various embodiments. The scales of the illustrations are not intended to be limiting, such as for example, the relative dimensions of an adhesive layer when compared to paper thickness and spool dimensions.

Figures 5, 5A:
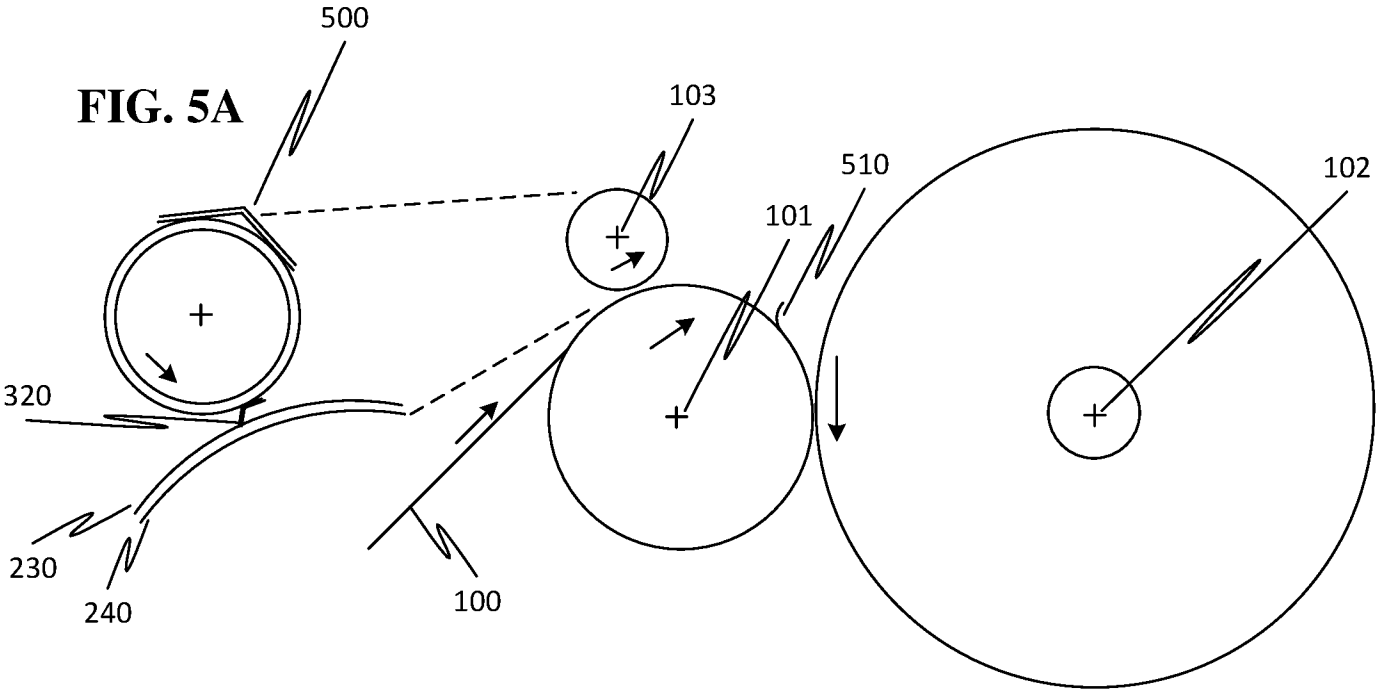
FIG. 5 is an illustration of a paper processing system where Turn-Up has occurred.
FIG. 5A is an exploded view of an exemplary paper processing system where Turn-Up has occurred.

As illustrated in FIGS. 5 and 5A, as the Empty Web Spool continues to advance with the paper web attached to the adhesive it may eventually tear or burst the paper web 500 away from the last portion 510 of the paper web that is rolling onto the Parent Web Spool. This completes the turnup process. The Empty Web Spool 102 may be moved out of the region of the reel drum 101. As the Empty Web Spool 102 is moved out of the region the Empty Web Spool may continue to pick up paper from the paper web 100 and be moved into the location that the Parent Web Spool had occupied before it was moved. In the embodiments discussed herein, the fact that the adhesive that the paper web has attached to on the back of the Cover Flap is elevated above the spool surface may increase the energy involved in tearing the paper web which may improve the efficacy.

The Cover Flap Transfer Paper Constructs consist of an arrangement of a zone-coated carrier paper and adhesive tape that can be adhered to a new spool. And the function of a Cover Flap protects the adhesive that will eventually pick up and tear the paper web. The primary problem with applying adhesive tapes to a spool is that the dusty environment will blind the adhesive before it can be delivered to the nip to pick up the paper web. By integrating the Cover Flap the turn-up adhesive may be protected from the environment and contamination of the adhesive until just before it is needed. Various examples of Cover Flap Transfer Tape Constructs are described in following sections.

However, the nature of a combination of multiple layers of adhesive tape, protective liner, and/or carrier paper in assemblies result in structures that resist being wound into a roll suitable for storage, distribution and dispensing. The differential radii among the various layers may create issues such as differences in circumference and wrinkling, that can affect the performance of the system and may cause the system to delaminate.

In a solution a dispenser system can be formed that performs part of the creation of the Transfer Tape structure while dispensing the Transfer Tape and while at the point of dispensing the system to the spool face. Preformed materials may be dispensed from spools with the removal and discarding of unneeded materials during the application process.

For a Cover Flap Transfer Tape Construct a dispensing solution may be achieved by applying a double-sided adhesive tape across the full width of the zone-coated carrier paper and winding the product into a roll. The packaged rolls of liner and adhesive may not be in the final configuration designed to perform the turn-up, and these final steps of the processing may be performed concurrently with the dispensing of the material and application to the spool in the paper mill.

In some examples, the zone coated carrier paper may be formed by treating a carrier paper with a silicone release material to the first face of the carrier paper in longitudinal stripes. When adhesive is applied to the zone coated carrier paper it may permanently adhere to the uncoated stripes, while being impermanently adhered to the coated stripes. In some examples, the second face of the release liner has stripes in an order and placement opposite to those on the first face. In some examples, the adhesive and release liner are laminated together and wound into a roll. Again, the adhesive adheres permanently to the uncoated stripes of the second face of the release liner that has been laid upon the adhesive of the previous layer wound into the roll. In some examples, when the outer-most layer of carrier paper is pulled away from the underlying layer, the adhesive separates into ribbons defined by the alternating coated and uncoated stripes.

In some examples, dispensing and completed processing may be completed by folding the carrier paper in half lengthwise. The outer face on one side of the folded ribbon presents adhesive that adheres the product to the face of the new spool. The product may be oriented with the edges pointing in the direction of spool rotation, while the fold is trailing. In examples without a remaining fold, the similar sides may be oriented in a similar manner.

An outer face of the folded carrier paper may not have adhesive on it. This side may face the paper web as the spool is set for the turn-up. The forward edge of the Cover Flap Transfer Tape Construct as dispensed in this manner may be caught in the air around the spinning spool and lifts up and folds back, exposing the adhesive ribbon that had been protected by the folded carrier paper. Again, in this manner, fresh adhesive may be presented to the paper web when the nip between the empty spool and the reel drum is closed. The paper web may adhere to the exposed adhesive and may follow the circumference of the empty spool. The change in direction ruptures the web in tension and the turn-up may be complete in a process as has been depicted in FIGS. 1-5.

Figure 6A:
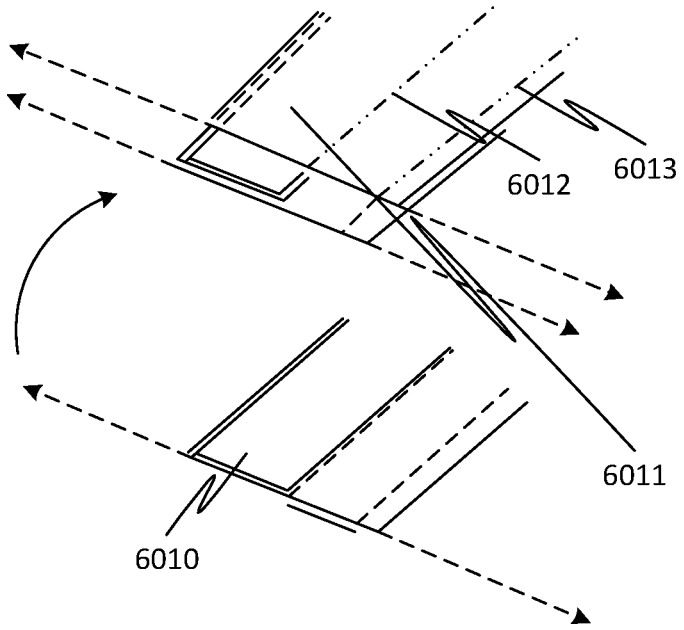
FIGS. 6A-6F illustrates aspects of Transfer Tape construct processing.

An exemplary processing flow to form a Cover Flap Transfer Tape Construct may follow. Referring now to FIG. 6A carrier paper with zone coated release 6010 may be received in a standard roll width. Double sided Adhesive Tape 6011 may be laminated to the first surface of the carrier paper and may be kiss-cut 6012, 6013 at the edges of the coated stripes.

Figure 6B:
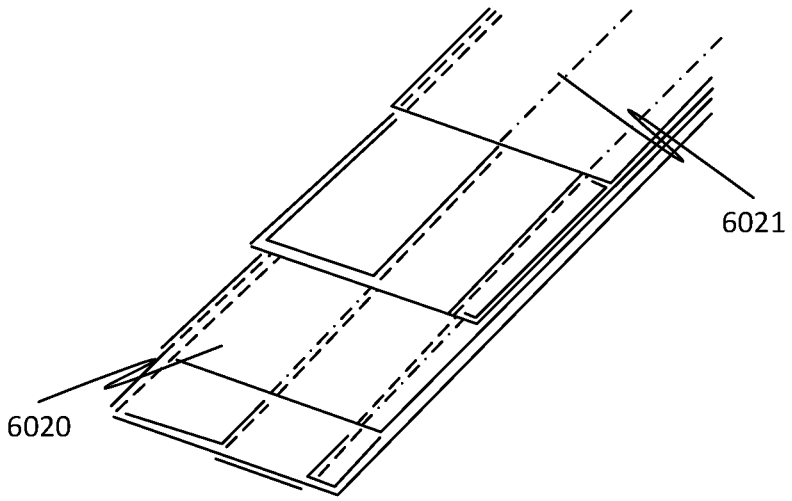

Referring now to FIG. 6B, a wide continuous sheet of double sided adhesive tape which has been laminated to the carrier paper may be slit to a needed width. Separate strips 6020, 6021 of the resulting tape material may be ribbon-wound. In the variations as are illustrated, no release paper is inserted between layers, so the exposed adhesive of the bottom layer is covered directly by the carrier paper of the next layer.

Figure 6C:
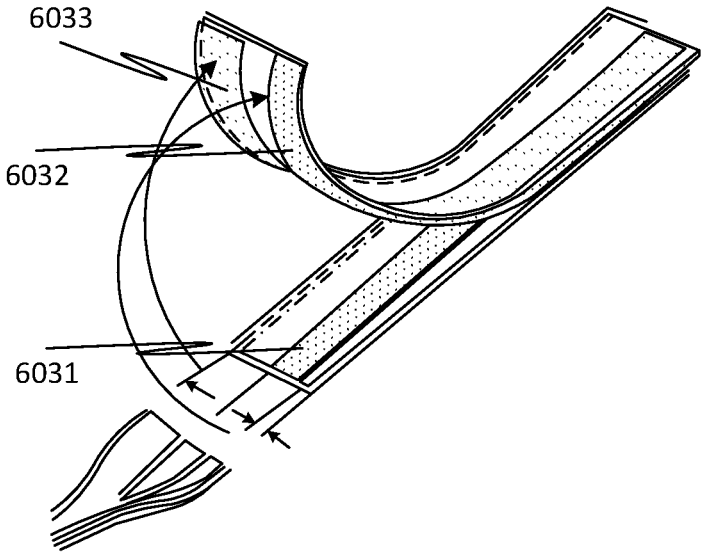

Referring now to FIG. 6C, the dispensing of the zone coated paper and laminated double sided adhesive tape causes ribbons of adhesive adhered to the uncoated areas of the first surface 6031 and transfers ribbons of adhesive 6032,6033 to the uncoated areas of the second face of a layer pulled from the roll. The double sided adhesive tape may separate into stripes along the kiss-cuts as illustrated.

Figure 6D:
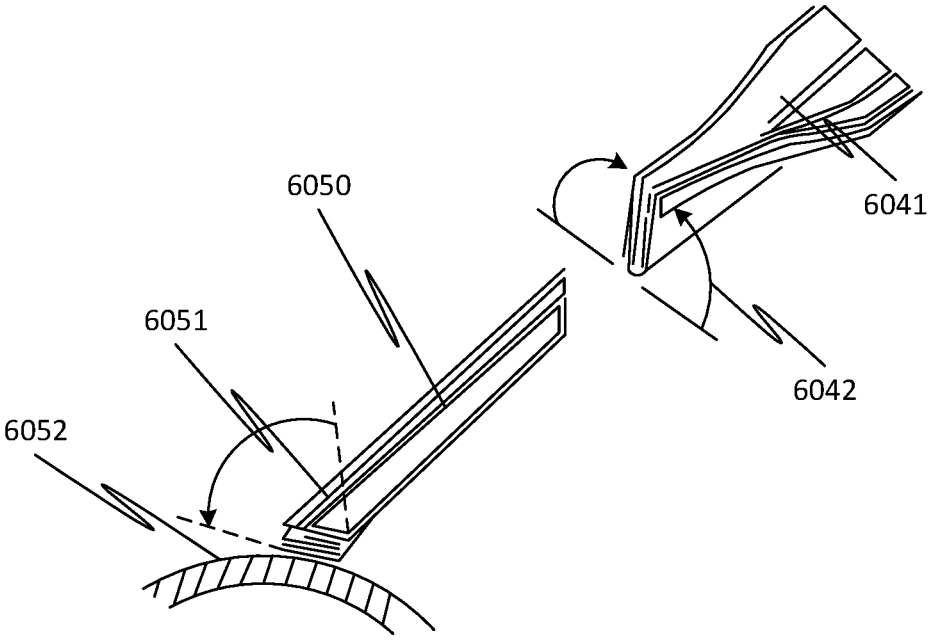

Referring now to FIG. 6D the composite tape strip 6041 may be folded 6042 in half. The strip may be twisted ninety degrees 6050 to attach the strip 6051 to the new spool 6052 by the exposed adhesive. This may result in the strip being firmly adhered to the face of the spool while the adhesive that will pick up the paper web is protected by the upper half of the folded strip. The open side of the folded strip points in the direction of the spool rotation and the fold acts as a hinge around which the upper half will turn when the air around the spinning spool lifts it.

Figure 6E:
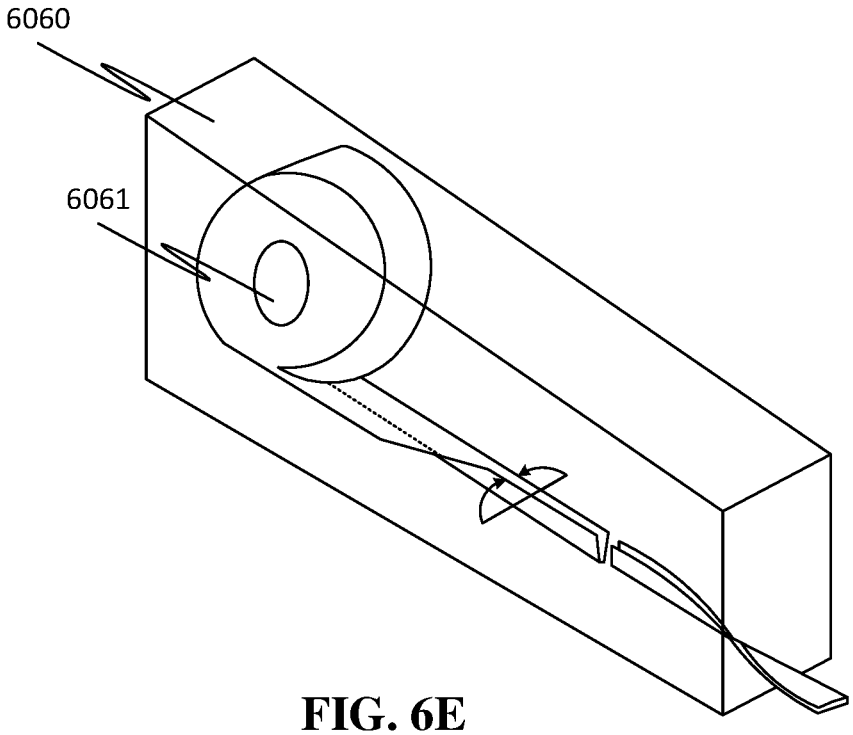

Referring now to FIG. 6E, an applicator package 6060 may contain the roll of prepared carrier paper and adhesive 6061. The applicator package 6060 may be equipped with mechanisms to perform the final processing and application steps to apply the product directly to the spool without manual intervention. The operator may press the leading end of the folded system to the spool and move the applicator package along the length of the spool before the spool is lifted into the primary arms. Thereafter, the applied Cover Flap Transfer Turn-up Construct may function to achieve Turn-Up without further operator action.

Figure 6F:
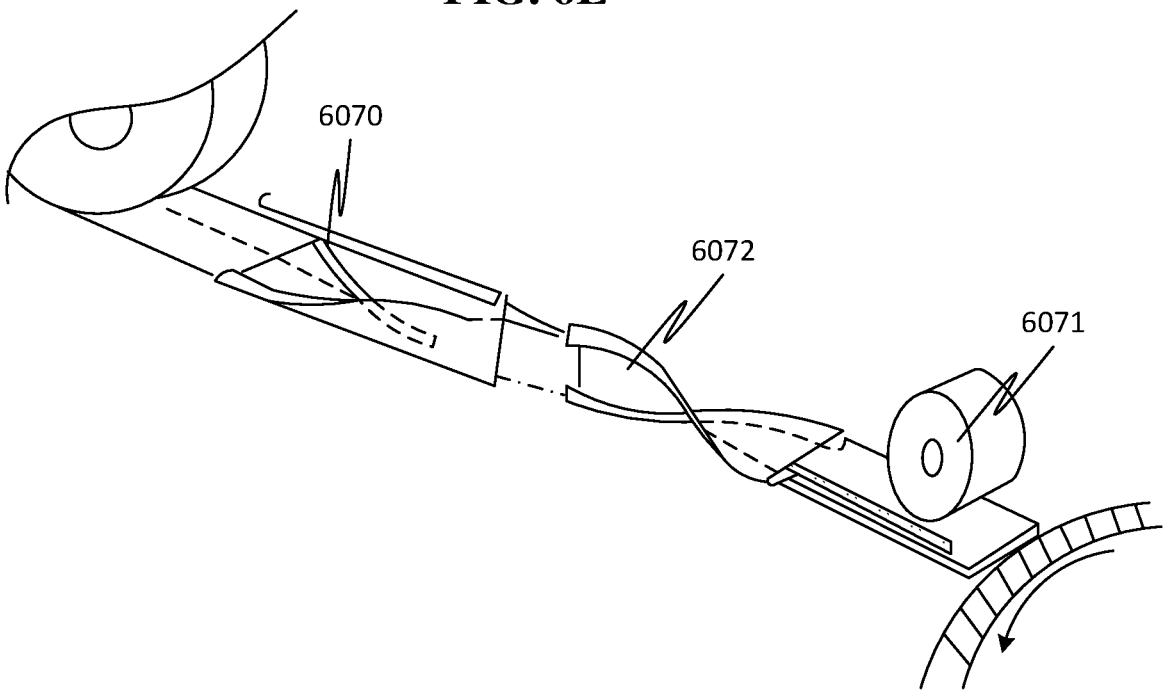

Proceeding to FIG. 6F, the carrier paper and adhesive may be folded lengthwise and twisted before being applied to the spool. FIG. 6F illustrates a 'creasing wire' 6070 in the folding mechanism of the dispenser applicator. In some examples, a wheel may be utilized. In some examples, the creasing wire or the wheel may have a non-stick coating to prevent fouling with adhesive, and non-stick coatings may be common for the remainder of the folding mechanism.

Again, referring to FIG. 6F, a pressing wheel 6071 may be used to firmly press the product to the spool. There may be numerous means to apply pressure to attach the Cover Flap Transfer Tape Construct to the surface such as a wiper or similar apparatus that can apply pressure to the application. In some examples, a compressible polymer foam hub 6072 may provide constant friction and keep the construct well aligned. Other mechanisms may be used to keep the constant friction. Some examples follow to illustrate different ways that the methods and apparatus may be used to create solutions for paper processing turn-up.

Figure 7A:
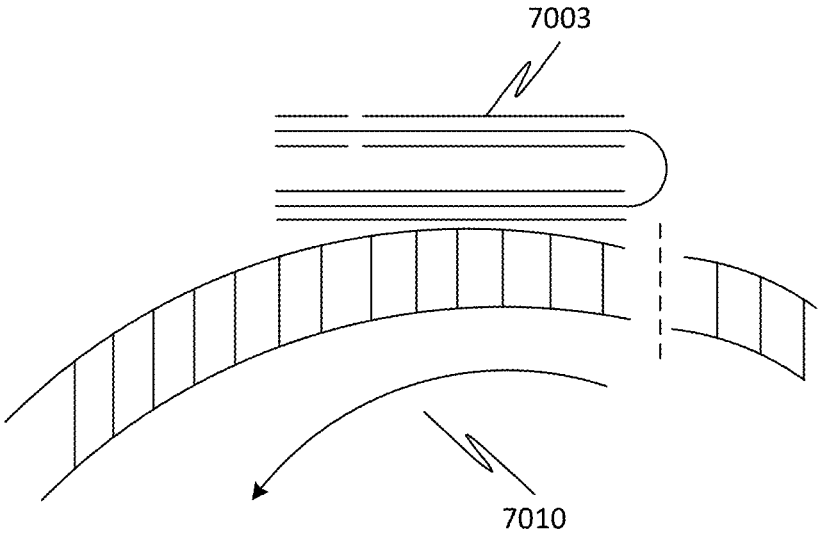
FIGS. 7A and 7B are close up illustrations of a Turn-Up construct.

Referring to FIG. 7A an illustration of a Cover Flap Transfer Tape Construct 7002 mounted on an Empty Web Spool 7001 is provided. The Cover Flap 7003 is illustrated in an original closed position. The spool may be turned in the direction indicated at arrow 7010. In some examples, spinning of the spool creates one or more of aerodynamic forces and centrifugal forces which act upon the Cover Flap 7003 to pull away from and increase as the rotational velocity of the spool increases. Therefore, the spool may still be rotating at a slower rate which allows for the closed Cover Flap 7003.

Figure 7B:
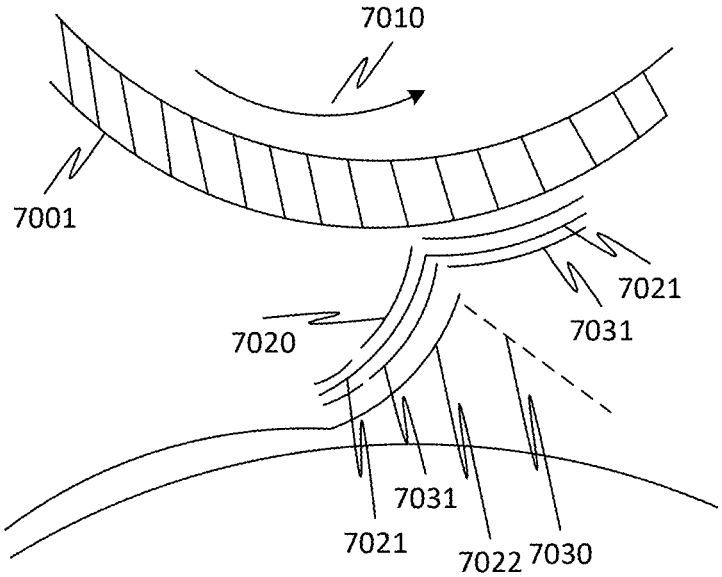

As the spool 7001 reaches a sufficient speed as it rotates in the direction of arrow 7010 the cover flap 7020 may detach from the tape construct and open. Referring to FIG. 7B the flap 7020 is shown in the open position which exposes an adhesive 7021 layer on the underside of the Cover Flap which interacts with the paper web 7022. As the paper web 7022 adheres to the adhesive layer 7021 attached to the Cover Flap 7020, the paper web 7022 may be pulled until the paper web 7022 severs 7030, the severing may include for example tearing of the paper or other separation of fibers included in the paper web until there is no longer a contiguous sheet of paper web 7022.

As has been discussed generally in previous sections, and as can be seen in the illustrations, the rotational movement of the empty spool 7001 causes the flap 7020 to elevated off of the empty spool 7001 and bridge a gap between the empty spool 7001 and the paper web 7022 such that the adhesive 7021 adheres to the paper web 7022. However, prior to elevating off of the empty spool 7001, the adhesive 7021 is protected by the cover flap 7020 and is not exposed to sufficient particles (such as for example paper particles) and other air borne environmental contaminants to significantly impair the adhesive qualities of the adhesive 7021 until the empty spool 7001 spins up to speed. A desired spin up speed may be measured as rotations per minute of the empty spool. In some embodiments, the desired spin sup speed rotations per minute will be based upon, such as within 10% of the surface speed of a paper web 7022 that is spinning on a full spool (not shown in FIG. 7A or 7B).

In some embodiments, a release layer 7031 may be coated on a base of the Cover Flap Transfer Tape Construct 7002 to facilitate the adhesive layer 7021 on the cover flap separating from the release layer 7031.

There may be numerous types of Cover Flap Transfer Tape Constructs that may be formed with the methods and apparatus as have been described. In the following sections different examples are described and illustrated to highlight different features and function that may be created.

Figure 8A:
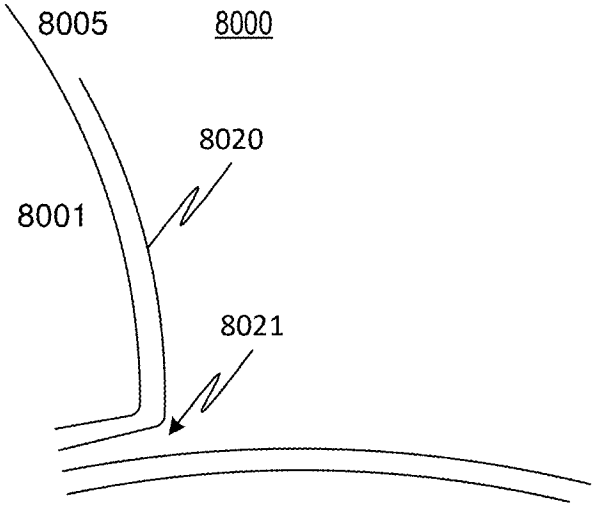
FIGS. 8 and 8A illustrate an example with adhesive on a Cover Flap.
Figure 8:
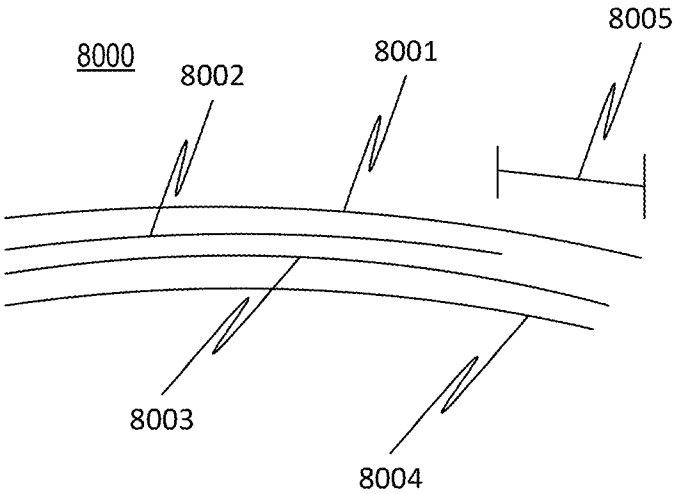

Proceeding to FIG. 8, an exemplary Cover Flap Transfer Tape Construct 8000 according to some embodiments of the present invention is illustrated. In some embodiments, an adhesive layer 8002 is included under a cover flap 8001. The underlying adhesive layer 8002 is illustrated along with a base transfer tape substrate 8003, and a base adhesive layer 8004. In these embodiments, the dimensions of the cover flap 8001 create an overhang 8005 that extends beyond the adhesive layer 8002. In these examples, the Cover Flap 8001 and the base transfer tape substrate 8003 are about the same width and length (within one centimeter of each other).

To form the Cover Flap Transfer Tape Construct 8000, Cover Flap adhesive 8002 is masked when applied to the Cover Flap Transfer Tape substrate 8001. Methods have been described for how to create the patterned layers of adhesive upon the tape substrate. Other means may also be possible. Alternatively, the adhesive layer 8002 may be formed of a double sided adhesive tape with a dimensional width that is smaller than a width of the two substrate layers and the other base adhesive layer 8004.

Referring now to FIG. 8A, the Cover Flap Transfer Tape Construct 8000, is illustrated with a Cover Flap 8001 in an open position and an adhesive 8020 exposed to the environment (exposed adhesive 8020). The overhang 8005 feature may present a portion of the Cover Flap 8001 that extend beyond the adhesive 8002. During rotation of an empty spool to which the Cover Flap Transfer Tape Construct 8000 is attached, aerodynamic effects may be enhanced via circulation of air beneath the opening of the Cover Flap 8001 that is formed by the overhang 8005.

As is illustrated, in performing a turn up procedure, the Cover Flap 8001 opens, but still maintains an area of the Cover Flap 8005 that remains adhered to the rest of the transfer tape construct as it engages, adheres to, and pulls the paper web towards the Empty Web Spool. Accordingly, the region 8021 beginning at the edge of the Cover Flap may be configured to fixedly hold the Cover Flap even under the aerodynamic forces, the centrifugal forces, and the forces related to attachment to the paper web. Maintaining the cover flap 8005 in a state of adherence to the transfer tape construct provides a safety benefit in not having the cover flap become a projectile due to its high speed of travel.

In some examples, the base Transfer Tape substrate 8003 may be treated with a release formulation such as a silicone based formulation that renders a surface that has a reduced adhesion strength. Thus, when the Cover Flap layers, particularly the Cover Flap Adhesive Layer 8002 are assembled into the construct, there may be a portion of the Cover Flap that is fixedly attached. It may also be practical to treat the Cover Flap Adhesive Layer 8002 with a release formulation in the region of desired release.

Although the general method of forming the adhesive regions discussed previously in some alternative examples, a combination of double sided tapes cut to appropriate dimensions may be used in a process that allows for straightforward release formulation treatment. For example, a narrow double sided tape with high adherence may be used to form the adhered portion. And relatively wider double sided tape may pass with one of its faces passing over a treatment region where a release composition may be applied by spray treatment or other such means. The modified tape may then have a well adhered side and a less adhered side.

Figure 9A:
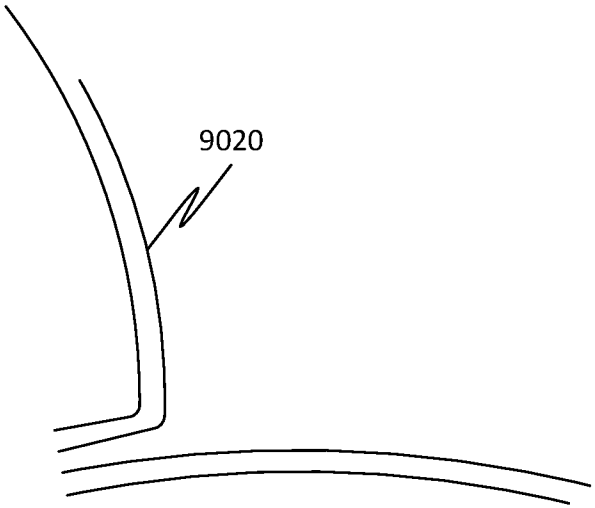
FIGS. 9 and 9A illustrate an example with adhesive on a Cover Flap.
Figure 9:
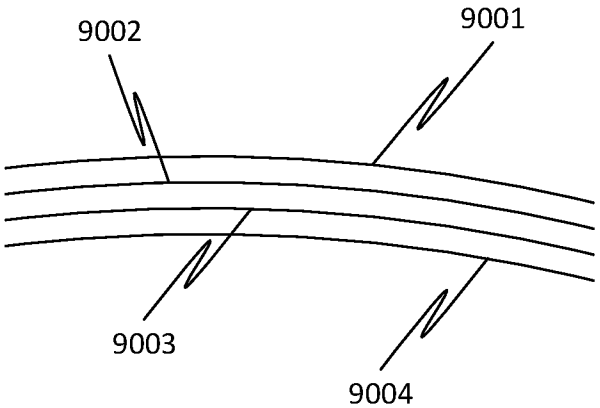

Referring to FIG. 9 another multilayered Transfer Tape construct is illustrated. However, in this example no overhang is present. The various layers have similar dimensions such as the Cover Flap Transfer Tape substrate 9001, the Cover Flap adhesive layer 9002, the base Transfer Tape substrate 9003, and the base adhesive layer 9004. As in the examples related to FIG. 8, a portion of the cover flap or underlying layers may need to be differentially treated to allow for a portion that releases and a portion that strongly adheres. Similar methods to achieve such a result may be applied to the examples of FIG. 9. When the Cover Flap opens as illustrated in FIG. 9A the underlying adhesive 9020 is exposed.

Figure 10A:
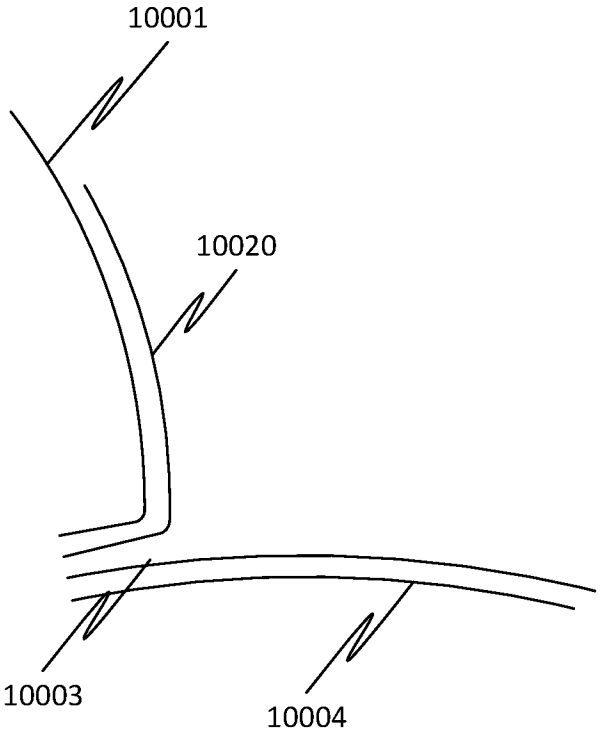
FIGS. 10 and 10A illustrate an example with adhesive on a Cover Flap.
Figure 10:
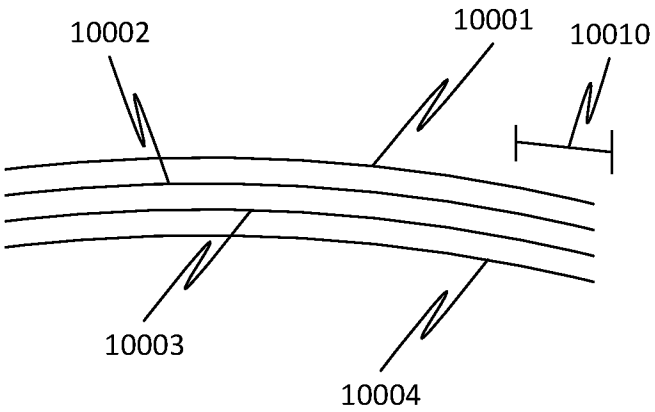

Referring to FIG. 10 another example of a multilayer Cover Flap Transfer Tape Construct with an overhang 10010 is illustrated. The construct may be very similar to the examples illustrated in FIG. 8 but where the overhang 10010 does not overlap base substrate and adhesive layers. The illustrated layers may include a Cover flap Transfer Tape substrate 10001, a Cover Flap adhesive layer 10002, a base Transfer Tape substrate 10003, and a base adhesive layer 10004. The design aspect that the overhang 10010 sits without any underlying structure over the spool that it is attached to may enhance the effect of aerodynamic forces on the Cover Flap. After the Cover Flap opens, a result may be as illustrated in FIG. 10A with exposed adhesive 10020.

Figure 11A:
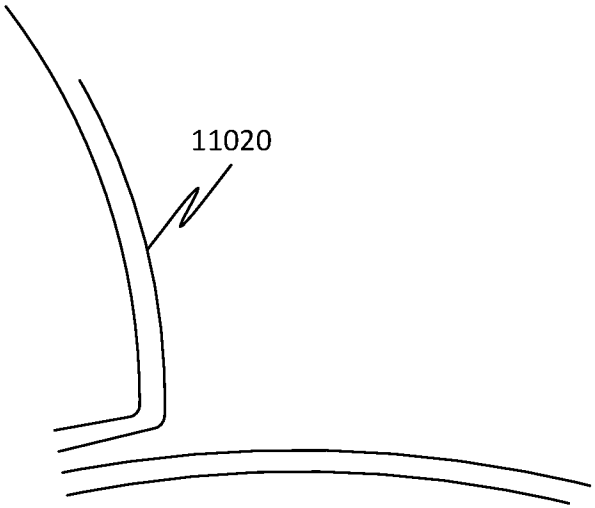
FIGS. 11 and 11A illustrate an example with adhesive on a Cover Flap.
Figure 11:
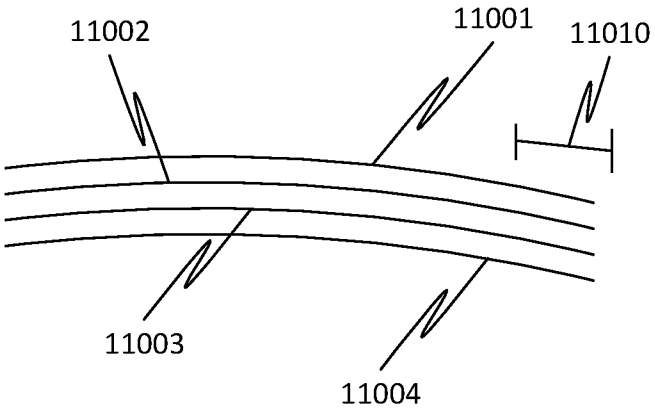

Referring to FIG. 11 another variation of multilayer Cover Flap Transfer Tape Construct with an overhang 11010 is illustrated. In this example, the overhang has an adhesive layer under it as well. The layers include a Cover flap Transfer Tape substrate 11001, a Cover Flap adhesive layer 11002, a base Transfer Tape substrate 11003, and a base adhesive layer 11004, exposed adhesive 11020 when the Cover Flap opens in FIG. 11A. The base transfer tape substrate 11003 may have a region that is either treated to enhance adhesive bonding or is conversely a region of the substrate that is not treated. Thus, the Cover Flap remains adhered as it attaches the paper web as discussed previously. In some examples, the manufacture of the Cover Flap Transfer Tape Construct of FIG. 11 may be simplified by having commonality of the Cover Flap layers with each other and of the Base layers with each other.

Figure 12A:
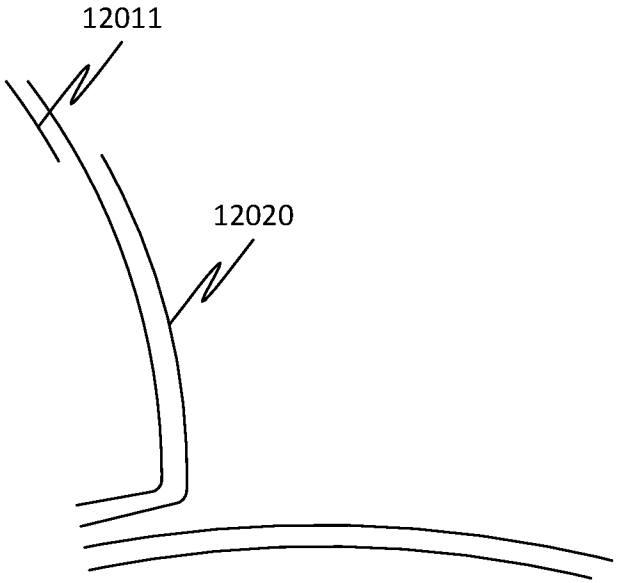
FIGS. 12 and 12A illustrate an example with adhesive on a Cover Flap.
Figure 12:
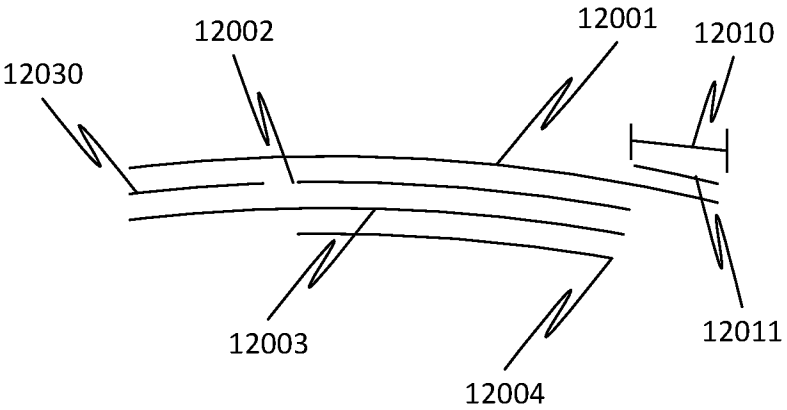

Referring to FIG. 12 a multilayer Transfer Tape construct with an overhang 12010 where the overhang 12010 does not have an underlying adhesive layer but does have an overlying adhesive security layer 12011 is illustrated. The construct includes a Cover flap Transfer Tape substrate 12001, a Cover Flap adhesive layer 12002, a base Transfer Tape substrate 12003; and a base adhesive layer 12004. The base Transfer Tape substrate 12003 also has a separated attachment layer 12030 that joins the Cover Flap Transfer Tape substrate 12001 and the base Transfer Tape substrate 12003.

In previous sections, discussion has been made of the potential to form adhesive layers as composite layers of multiple tape dimensions. In the illustration of FIG. 12 the formation of the adhesive layer of 12002 and 12030 may be formed in that manner from a set of different sized adhesive layers. As well, and additional layer of adhesive to form a security layer may be formed. As shown in FIG. 12A, when the top flap is opened during the spin up of a spool that the construct is attached to, the Cover Flap may open exposing the underlayer of adhesive 12020. The top security layer 12011 may have numerous roles. In a first role, the added mass of the adhesive feature may enhance the effect of centrifugal force in opening the Cover Flap. In another role, in some examples, as the cover flap opens it will tend to be forced by the aerodynamic forces to completely fold over onto the spool. When the security feature interacts with the spool it can hold the Cover Flap in a deployed position.

Figure 13A:
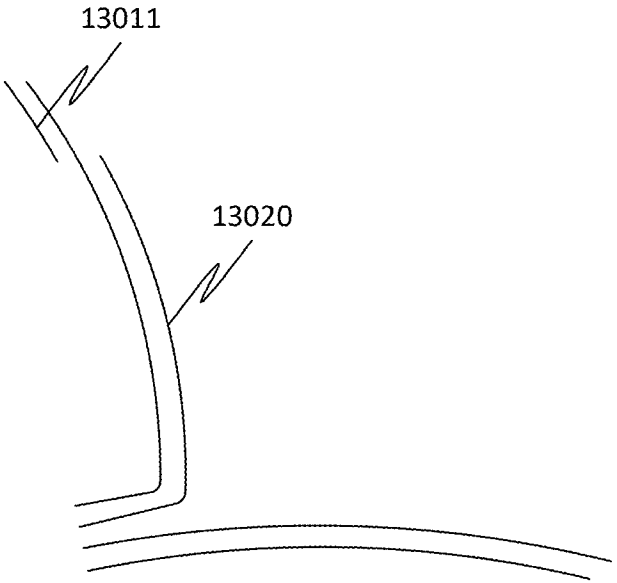
FIGS. 13 and 13A illustrate an example with adhesive on a Cover Flap.
Figure 13:
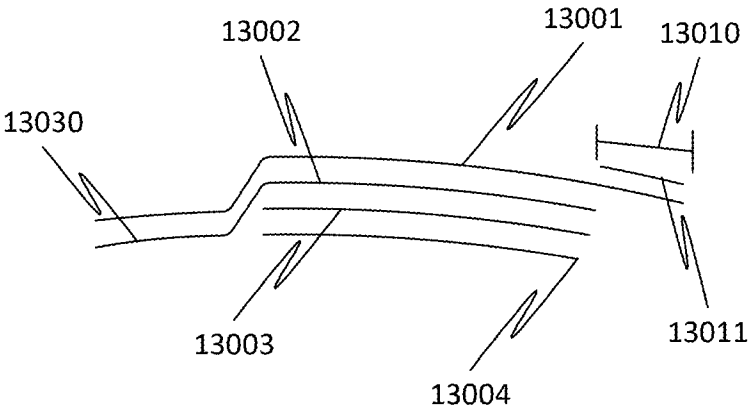

Referring to FIG. 13 another example of a multilayer Transfer Tape construct with an overhang 13010 where the overhang does not have an underlying adhesive layer but does have an overlying adhesive security layer 13011 is provided. Much of the previous discussion applies in the example of FIG. 13. However, in this example, the Cover Flap layers overlap both sides of the Cover Flap Transfer Tape Construct. The layers may then be deformed such that the attachment overlap 13030 has its adhesive portion at the same level as the base Transfer Tape substrate adhesive. In general, the layers of the construct may be identified as a Cover flap Transfer Tape substrate 13001, a Cover Flap adhesive layer 13002, a base Transfer Tape substrate 13003; and a base adhesive layer 13004. The Cover Flap substrate 13001 and Cover Flap adhesive layer 13002 are deformed to match the level of the bottom of the base adhesive layer 13004 in the attachment overlap 13030. In this construct, the attachment overlap directly attaches to the spool making for a strong bond to hold when the Turn-up occurs. Again, in FIG. 13A when the Cover Flap opens the underlying adhesive is exposed 13020.

Figure 14A:
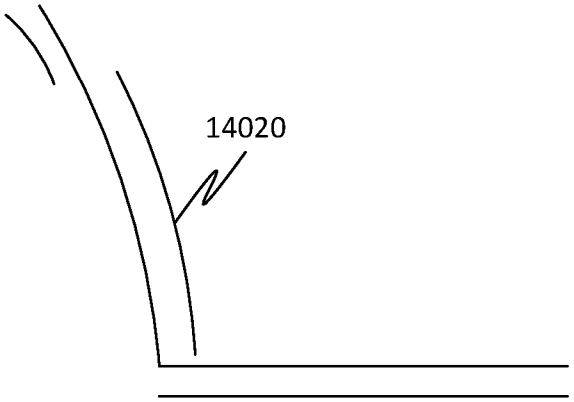
FIGS. 14 and 14A illustrate an example with adhesive on a Cover Flap.
Figure 14:
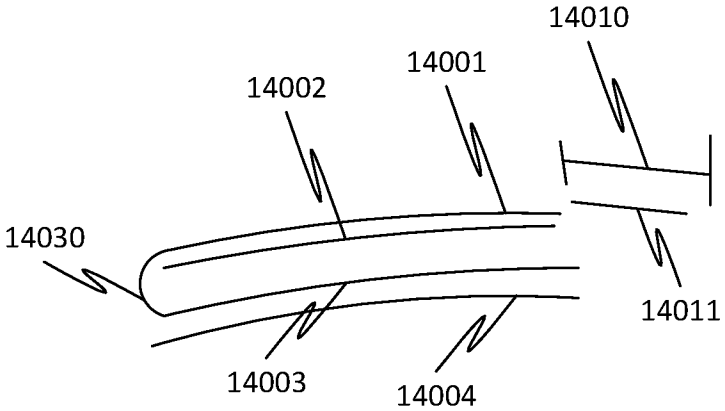

Referring to FIG. 14 another example of a multilayer Cover Flap Transfer Tape Construct with an overhang 14010 where the overhang does not have an underlying adhesive layer but does have an overlying adhesive security layer 14011 is illustrated. The construct may have the following features: a Cover flap Transfer Tape substrate 14001, a Cover Flap adhesive layer 14002, a base Transfer Tape substrate 14003, and a base adhesive layer 14004. A distinguishing aspect of this example is that the Cover Flap Transfer Tape substrate and the base Transfer Tape substrate are a contiguous layer as may be formed by bending 14030 an initial piece into the two regions. This may result in a strong Cover Flap strength as a relatively large adhesive footprint is combined with material strength of the substrate layer. Referring to FIG. 14A, exposed adhesive 14020 is presented when the Cover Flap opens.

Figure 15A:
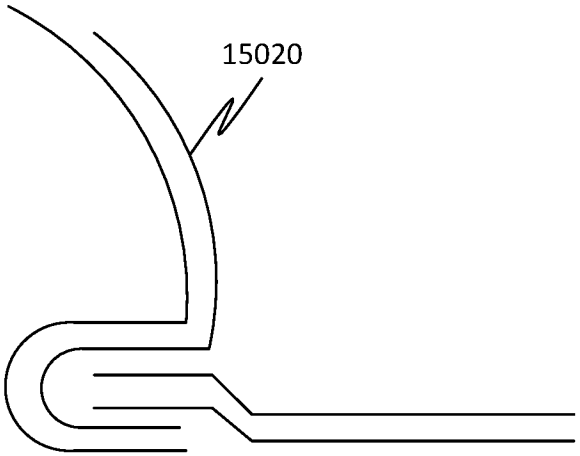
FIGS. 15 and 15A illustrate an example with adhesive on a Cover Flap.
Figure 15:
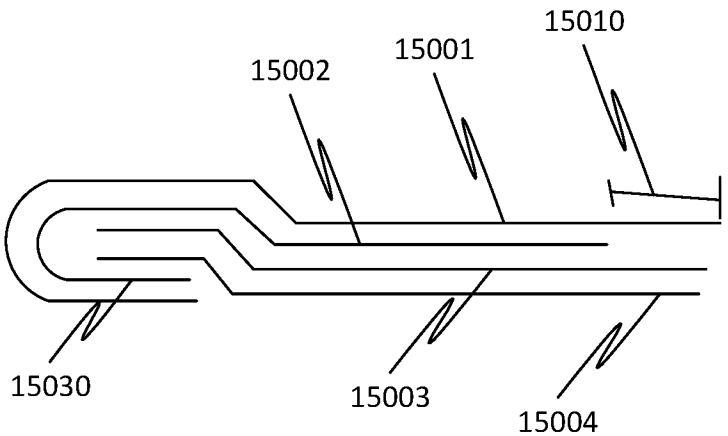

Referring to FIG. 15 another example of a multilayer Cover Flap Transfer Tape Construct with an overhang 15010 where the overhang does not have an underlying adhesive layer is illustrated. The example may include a Cover flap Transfer Tape substrate 15001, a Cover Flap adhesive layer 15002, a base Transfer Tape substrate 15003, and a base adhesive layer 15004. The differentiating factor for this example is that a hinge connection 15030 is created by folding and overlapping portion of the Cover Flap underneath the Base adhesive layer. Cover Flap substrate 13001 and Cover Flap adhesive layer 13002 are deformed to receive a bent portion of the Cover Flap adhesive 15002 and the Cover Flap substrate 15001. The bonding of the two adhesive layers and the bending of the attached layers form a hinge joint 15030. When the Cover Flap opens during use, as illustrated in FIG. 15A, the underlying adhesive 15020 is exposed.

Particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed invention.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

As has been mentioned, the illustrations depict aspects of exemplary embodiments, and the relative scale of illustrated features may be exaggerated for depiction of various aspects. Accordingly, the scale of features illustrated is not intended to limit the scope of the elements of the various embodiments consistent with the present application.

What is claimed is:

1. A method for performing a turn up process on a paper making machine, the turn up process comprising the steps of:

a) mounting a cover flap transfer tape construct, comprising a cover flap over a tape construct and an adhesive layer on an underside of the cover flap, onto an empty web spool using an applicator package comprising a roll of prepared carrier paper and an adhesive that are dispensed from the applicator package to form the cover flap transfer tape construct, said adhesive layer is positioned over a release layer coated on a base of the cover flap transfer tape construct to facilitate the adhesive layer on the underside of the cover flap separating from the release layer during the turn up process;

b) twisting the prepared carrier paper and the adhesive in the applicator package for mounting the cover flap transfer tape construct onto the empty web spool;

c) spinning the empty web spool and the cover flap transfer tape construct mounted on the empty web spool at a rotation speed sufficient to cause one or both of: aerodynamic forces and centrifugal forces to act on the cover flap;

d) as a result of the one or both of aerodynamic forces and centrifugal forces acting on the cover flap, separating the cover flap and the adhesive layer from the release layer to expose the adhesive layer;

e) with the cover flap and the adhesive layer elevated off of the empty web spool due to the spinning of the empty web spool, bridging a gap between the empty web spool and a surface of a paper web;

f) adhering the exposed adhesive layer to the paper web; and g) continuing to spin the empty web spool and the cover flap transfer tape construct until the paper web severs via separation of fibers included in the paper web.

2. The method of claim 1, additionally comprising the step of folding the prepared carrier paper with the adhesive lengthwise, wherein the twisting is performed using a creasing wire in a folding mechanism of the applicator package.

3. The method of claim 2, wherein the creasing wire has a non-stick coating to prevent fouling with the adhesive.

4. The method of claim 3, further comprising using a pressing wheel to firmly press the cover flap transfer tape construct to the empty web spool.

5. The method of claim 4, additionally comprising the step of extending the cover flap beyond the adhesive layer as a cover flap overhang.

6. The method of claim 4, additionally comprising the step of aligning an end of the adhesive layer with an end of the cover flap.

7. The method of claim 4, additionally comprising the step of extending the cover flap and the adhesive layer beyond a substrate of the cover flap transfer tape construct.

8. The method of claim 4, additionally comprising the step of opening the cover flap to expose the adhesive layer but leaving the cover flap attached to the cover flap transfer tape construct while the adhesive layer attaches to the surface of the paper web.

9. The method of claim 8, wherein a first portion of the cover flap transfer tape construct comprises a portion of a surface treated with a reduced adhesion strength substance.

10. The method of claim 9, wherein the reduced adhesion strength substance comprises a silicon-based formulation.

11. The method of claim 9, wherein the cover flap transfer tape construct comprises a second portion of the surface that is untreated with the reduced adhesion strength substance.

12. The method of claim 8, wherein a first portion of the cover flap transfer tape construct comprises a portion of a surface with an increased adhesion strength substance.

13. The method of claim 4 additionally comprising the step of attaching an overlying security adhesive layer to the cover flap.

14. The method of claim 13 additionally comprising the step of folding the cover flap back onto itself and adhering the overlying security adhesive layer to the cover flap.

15. The method of claim 1, wherein the twisting is performed using a creasing wire located in the applicator package.

16. The method of claim 1, wherein the prepared carrier paper and the adhesive are twisted substantially ninety degrees before being dispensed from the applicator package.

* * * * *